US005356508A

United States Patent [19]

Watanabe

[11] Patent Number: 5,356,508

[45] Date of Patent: Oct. 18, 1994

[54] APPARATUS FOR CONTINUOUSLY APPLYING LABELS TO ARTICLES

[75] Inventor: Tomoichi Watanabe, Tokyo, Japan

[73] Assignee: Japan Tobacco, Inc., Tokyo, Japan

[21] Appl. No.: 40,982

[22] Filed: Mar. 31, 1993

[30] Foreign Application Priority Data

Mar. 31, 1992 [JP] Japan ..... 4-105670

[51] Int. Cl.[5] ..... B65C 9/00

[52] U.S. Cl. ..... 156/566; 156/475; 156/492; 156/567; 156/DIG. 42

[58] Field of Search ..... 156/475, 486, 492, 566, 156/567, DIG. 31, DIG. 42; 53/234

[56] References Cited

U.S. PATENT DOCUMENTS

| | | | |
|---|---|---|---|
| 1,536,837 | 5/1925 | Fredsell | 156/DIG. 42 X |
| 2,754,990 | 7/1956 | Scott | 156/DIG. 42 X |
| 2,984,378 | 5/1961 | Gunter | 156/567 X |
| 4,316,762 | 2/1982 | Martin | 156/DIG. 42 X |
| 4,338,155 | 7/1982 | Buchele | 156/567 X |
| 4,685,993 | 8/1987 | Flaherty et al. | 156/475 |
| 4,770,729 | 9/1988 | Spencer et al. | 156/475 X |
| 4,838,846 | 6/1989 | Focke et al. | 53/234 X |
| 5,009,741 | 4/1991 | Focke et al. | 156/566 X |

FOREIGN PATENT DOCUMENTS

| | | |
|---|---|---|
| 2475494 | 8/1981 | France . |
| 2055747 | 3/1981 | United Kingdom . |

*Primary Examiner*—David A. Simmons
*Assistant Examiner*—James J. Engel, Jr.

[57] ABSTRACT

An apparatus for applying seals to articles has a rotary table having heads, and an article guide provided along the periphery of the rotary table. Each head is provided with a holding-moving mechanism for holding an article and moving the article on and along the article guide together with the head, and a labeling mechanism for applying a label to the article which is being transferred together with the head. The article is held by the holding-moving mechanism and moved together with the head. During the transfer of the article, the label is applied to the article. The article can be applied with the label while the article is being continuously transferred without being moved intermittently, whereby the apparatus can be easily operated at a high speed.

17 Claims, 8 Drawing Sheets

APPARATUS FOR CONTINUOUSLY APPLYING LABELS TO ARTICLES

BACKGROUND OF THE INVENTION

1. Field of the Invention

This invention relates to an apparatus for continuously applying small labels to articles such as wrapped goods, and more particularly to an apparatus for continuously applying seals to end faces of wrapped cigarette cases.

2. Description of the Related Art

In general, an end face of a wrapped cigarette case is applied with a belt-like seal for sealing the cigarette case or for other purposes. The central portion of the seal is attached to the corresponding end face of the wrapped cigarette case, and both end portions of the seal are folded on the side faces of the wrapped cigarette case and adhered thereto.

In the conventional cigarette manufacturing processes, cigarette cases which have been wrapped completely are intermittently transferred while the cigarette cases halt, belt-like seals are applied to the ends of the wrapped cigarette cases and then both end portions of the seals are folded on and adhered to the side faces of the wrapped cigarette cases, by utilizing the conventional apparatus.

The recent cigarette manufacturing apparatus is adapted to be operated at an extremely high speed. The processes from the manufacture of cigarettes to the wrapping of the cigarettes are performed in series. As cigarette manufacture speeds up, therefore, the number of cigarette cases which are wrapped in a unit time increases.

In order to increase the number of cigarette cases which are wrapped in a unit time, the operational speed of a seal applying apparatus must be enhanced. However, the conventional seal applying apparatus applies seals to wrapped cigarette cases which are moved intermittently, when they are stopped temporarily. The cigarette-case moving apparatus inevitably has an intermittently operating mechanism and, accordingly, cannot be moved at a very high speed due to the limitation of the inertial force of the intermittently operating mechanism.

SUMMARY OF THE INVENTION

The object of this invention is to provide an apparatus for continuously applying small labels such as seals to articles such as wrapped cigarette cases at a high speed while the articles are being transferred continuously.

The object of this invention is achieved by providing an apparatus for applying small labels to articles.

The apparatus according to this invention comprises a rotary table continuously rotating in a horizontal plane and provided on the peripheral portions thereof with a plurality of heads, and an arcuated article guide provided on the outer periphery of the rotary table.

Each head has a holding and transfer mechanism and a labeling mechanism. The holding-moving mechanism holds articles such as cigarette cases which are loaded on the article guide and moves the articles on and along the article guide at a speed equal to that of the heads. The labeling mechanism applies labels to articles which are moving together with the heads.

Since each article loaded on the guide is held by the holding-moving mechanism and is moved continuously on and along the article guide together with the head, no relative movement occurs between the article and the labeling mechanism mounted on the head while the article is being moved together with the head.

With the label applying apparatus according to this invention, labels are applied to continuously moving articles without moving the articles intermittently. Accordingly, label application can be carried out at a high speed without using a mechanism for transferring the articles intermittently.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of this invention will now be described. The apparatus of the embodiment is an apparatus for applying seals to cigarettes continuously.

Figure 1:
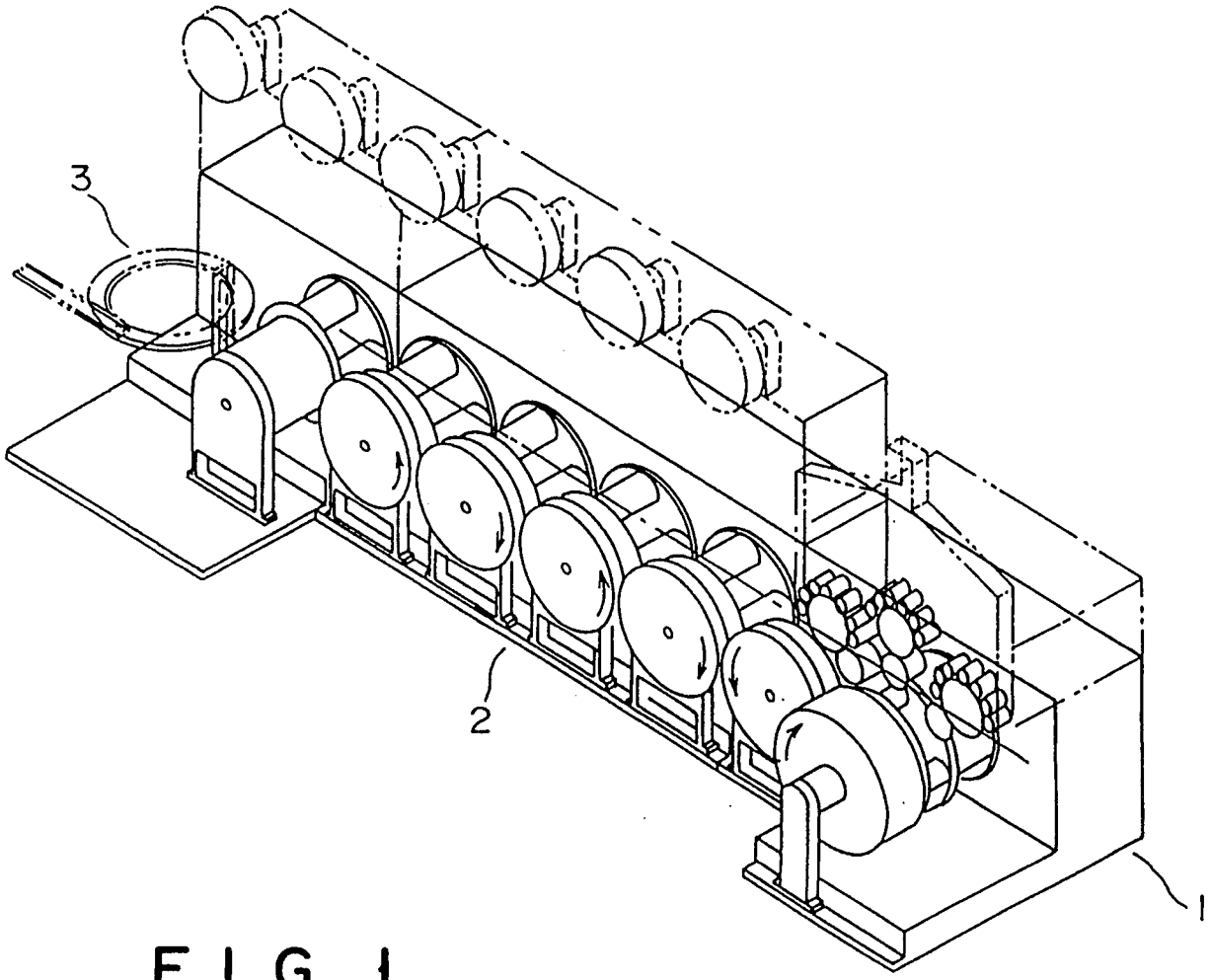
FIG. 1 is a general view of the overall cigarette wrapping device with which an embodiment of a sealing apparatus according to this invention is provided.

FIG. 1 shows a continuous cigarette-wrapping apparatus 1 which is provided with a row of rotary drums 2. Upon being continuously supplied to the spaces between the rotary drums, a predetermined number of cigarettes, for example, twenty cigarettes for a cigarette case are piled in a three layers and wrapped by a wrapping sheet or wrapping paper into a predetermined case shape. Seals are continuously applied to the wrapped cigarette cases by means of the sealing apparatus 3 of this invention.

Figure 2:
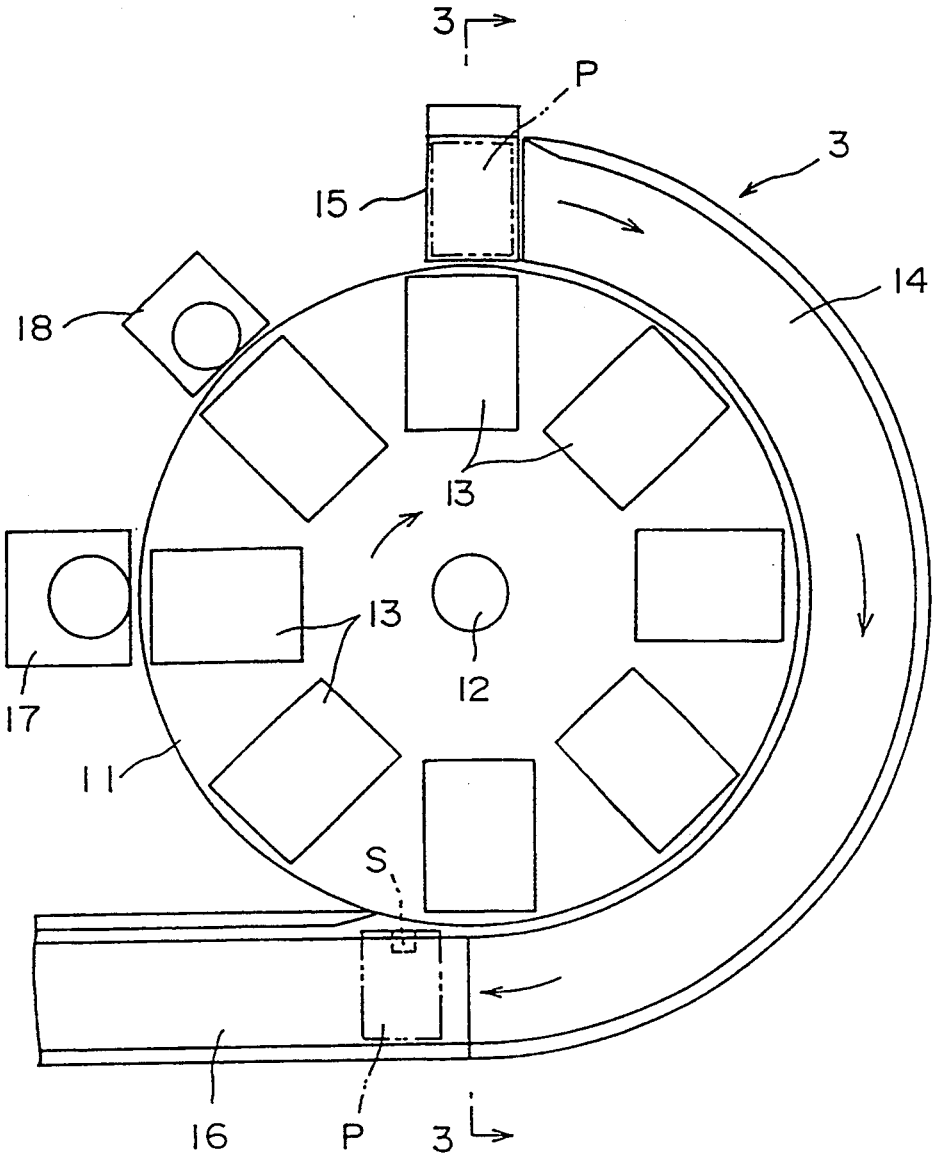
FIG. 2 is a general plan view of the embodiment of the sealing apparatus according to this invention.
Figure 3:
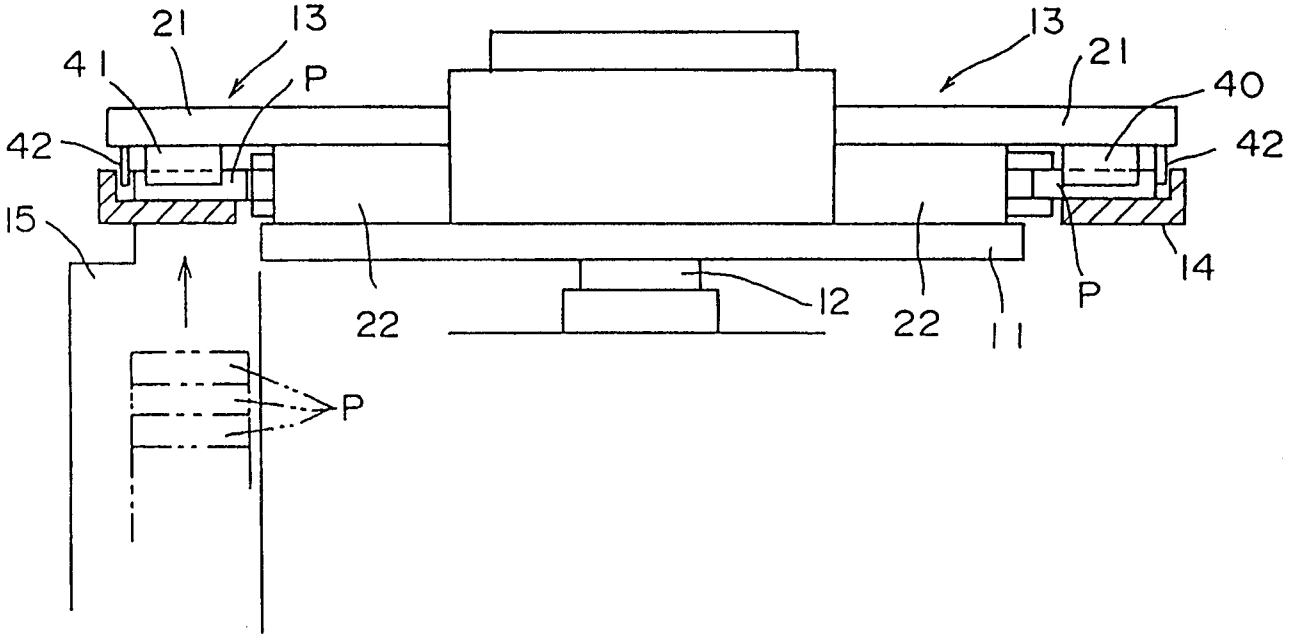
FIG. 3 is a general side elevational view along line 3—3 of FIG. 2.

FIGS. 2 and 3 shows a general structure of the sealing apparatus according to this invention, which is provided with a rotary table 11 continuously rotating in a horizontal plane. The rotary table 11 is rotatably supported by a fixed shaft 12 connected to the fixed portion of the apparatus and rotated at a predetermined speed by means of a conventional driving mechanism (not shown). On the peripheral portions of the rotary table 11, a plurality of heads 13 whose structure will be described in detail later are provided.

An arcuated cigarette-case guide 14, which is an embodiment of the article guide of this invention and has a substantially semi-circular shape extends along the circumference of the rotary table 11. A mechanism 15 for supplying wrapped cigarette cases P, which are embodiments of articles, is provided at the inlet portion of the guide 14. The cigarette-case supplying mechanism 15 moves the continuously supplied, wrapped cigarette cases P upward and loads them on the guide 14 with the end faces of the cigarette cases P to be applied with seals being directed radially inward, i.e., toward the rotary table 11. The outlet portion of the guide 14 is connected to a transportation conveyor 16 for transporting the cigarette cases P from the outlet portion of the guide 14 to the apparatus in the next process.

A seal supplying mechanism 17 and an adhesive supplying mechanism 18 are arranged at the periphery of the rotary table 11. They are provided at the upstream side of the inlet portion of the guide 14, i.e., at the upstream side in the direction of the rotary table 11 beyond the inlet portion of the guide 14.

The general operation of the apparatus will now be described. A cigarette case P is supplied to the inlet portion of the guide 14 by means of the supplying mechanism 15. When a head 13 on the rotary table 11 faces the seal supplying mechanism 17 as the rotary table 11 is rotated, a seal is supplied to the head 13 by means of the seal supplying mechanism 17 and sucked and held by the head 13. Then, the rotary table 11 is further rotated. When the head 13, which is holding the seal, faces the adhesive supplying mechanism 18, the adhesive supplying mechanism 18 applies an adhesive to the rear face of the seal held by the head 13.

when the head 13 arrives at the location of the cigarette case P at the inlet portion of the guide 14, the head 13 holds the cigarette case p and transfers the same on and along the guide 14. While the cigarette case P is being transferred on the guide 14, the seal S held by the head 13 is applied to the end face of the cigarette case p. When the cigarette case P applied with the seal S arrives at the outlet portion of the guide 14, the cigarette case P is released from the head 13 and is sent to the apparatus in the next process by means of the transportation conveyer 16.

Figure 4:
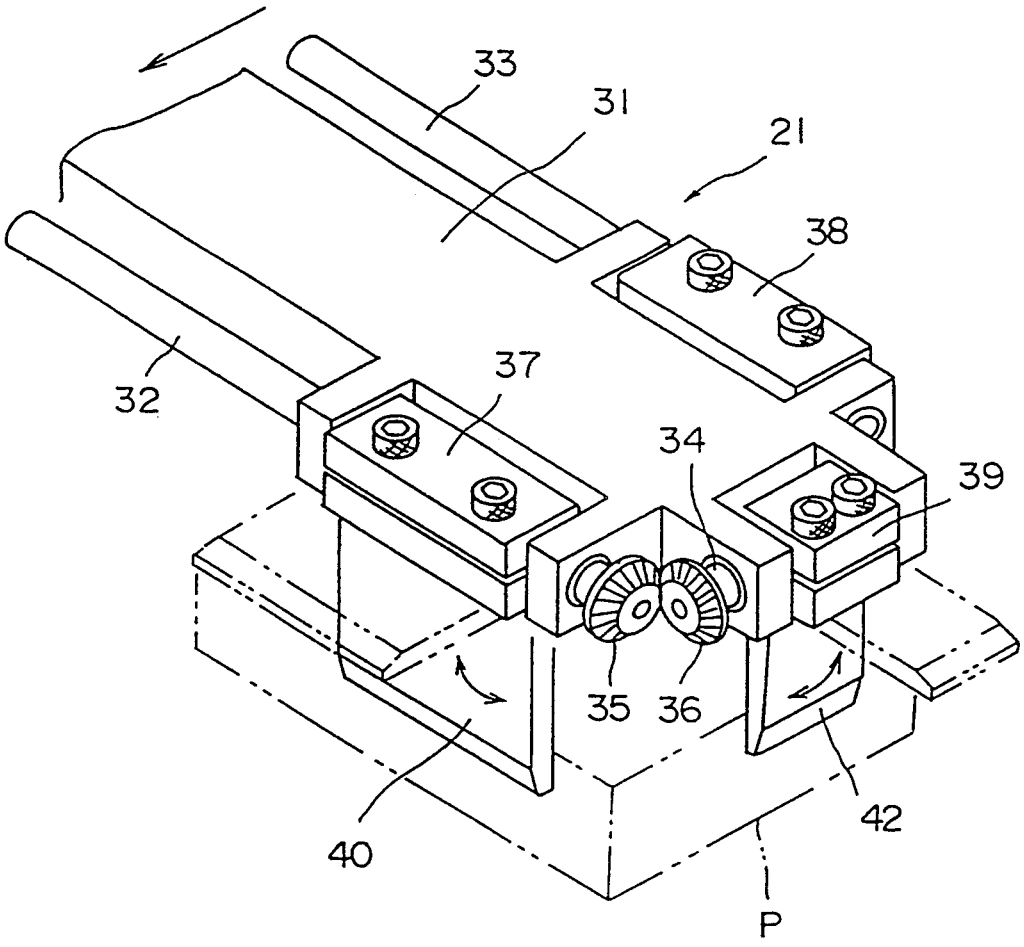
FIG. 4 is a perspective view of the main part of a holding-moving mechanism.

The structure of each head 13 will now be described. As shown in FIG. 3, the head 13 is provided with a holding-moving mechanism 21 and a seal applying mechanism 22. The holding-moving mechanism 21 whose main part is shown in FIG. 4 has a frame 31 extending radially outward of the rotary table 11 and crosswise over the guide 14. Rotary shafts 32 and 33 extend along both sides of the frame 31 and are rotatably supported by arm portions of the frame 31.

The front end portion of the frame 31 rotatably supports a rotary shaft 34 which intersects with the rotary shafts 33 and 32 at right angles and extends in the peripheral direction of the rotary table 11. The rotary shaft 32 is connected to the rotary shaft 34 by bevel gears 35 and 36. Fixing blocks 37, 38 and 39 are secured to the rotary shafts 32, 33 and 34, respectively. Holding members 40, 41 and 42 each having a plate shape extend downward from the respective fixing blocks 37, 38 and 39.

As the rotary shafts 32, 33 and 34 are rotated, the holding members 40, 41 and 42 are turned in horizontal directions shown by two-headed arrows in FIG. 4. When the holding-moving mechanism 21 is moved to the position over the cigarette case P at the inlet portion of the guide 14, the rotary shafts 32, 33 and 34 are rotated to turn the holding members 40, 41 and 42 downward. In this operation, the rotary shaft 33 is rotated first, and then the rotary shafts 32 and 34 are rotated in order to avoid interference of the holding members with the cigarette case. The holding members 40, 41 and 42 contact the radially outward end face and the side faces of the cigarette case P, respectively so as to hold the same and moves on and along the guide 14 together with the head 13.

Figure 6:
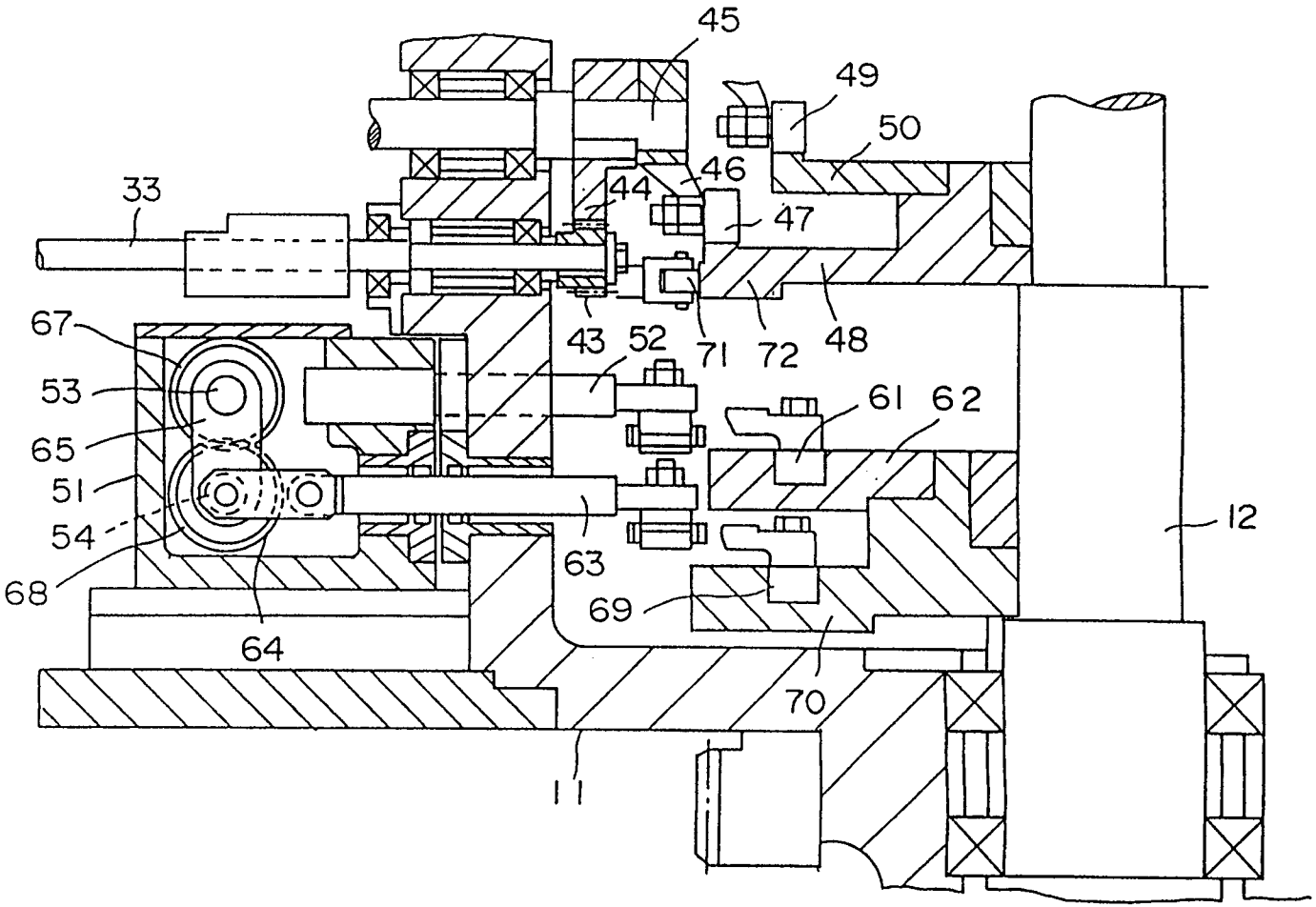
FIG. 6 is a longitudinal cross-sectional view of the mechanism comprising heads and a rotary table.

The holding-moving mechanism 21 is driven by a cam mechanism as shown in FIG. 6. The rotary table 11 is rotatably supported by the fixed shaft 12 secured to the fixed portion of the labeling apparatus and rotated by means of a driving mechanism (not shown) via a drive gear 51. The rotary shaft 33 is rotatably supported by the rotary table 11. The proximal end of the rotary shaft 33 is fixed to a gear 43 to which a cam lever 46 is connected via a segment gear 44 and a shaft 45. A cam 48 is securely connected to the fixed shaft 12, and a cam roller 47 which makes rolling contact with the cam 48 is fixed to the front end of the cam lever 6. The rotary shaft 32 is also connected to a cam mechanism which has the same structure as the one for the rotary shaft 33 and is provided with a roller cam roller 49 and a cam 50 for the rotary shaft 32.

The cam mechanisms rotate the rotary shafts 32 and 33 at predetermined timing in synchronism with the rotation of the rotary table 11, so as to operate the holding members 41 and 42.

Figure 5:
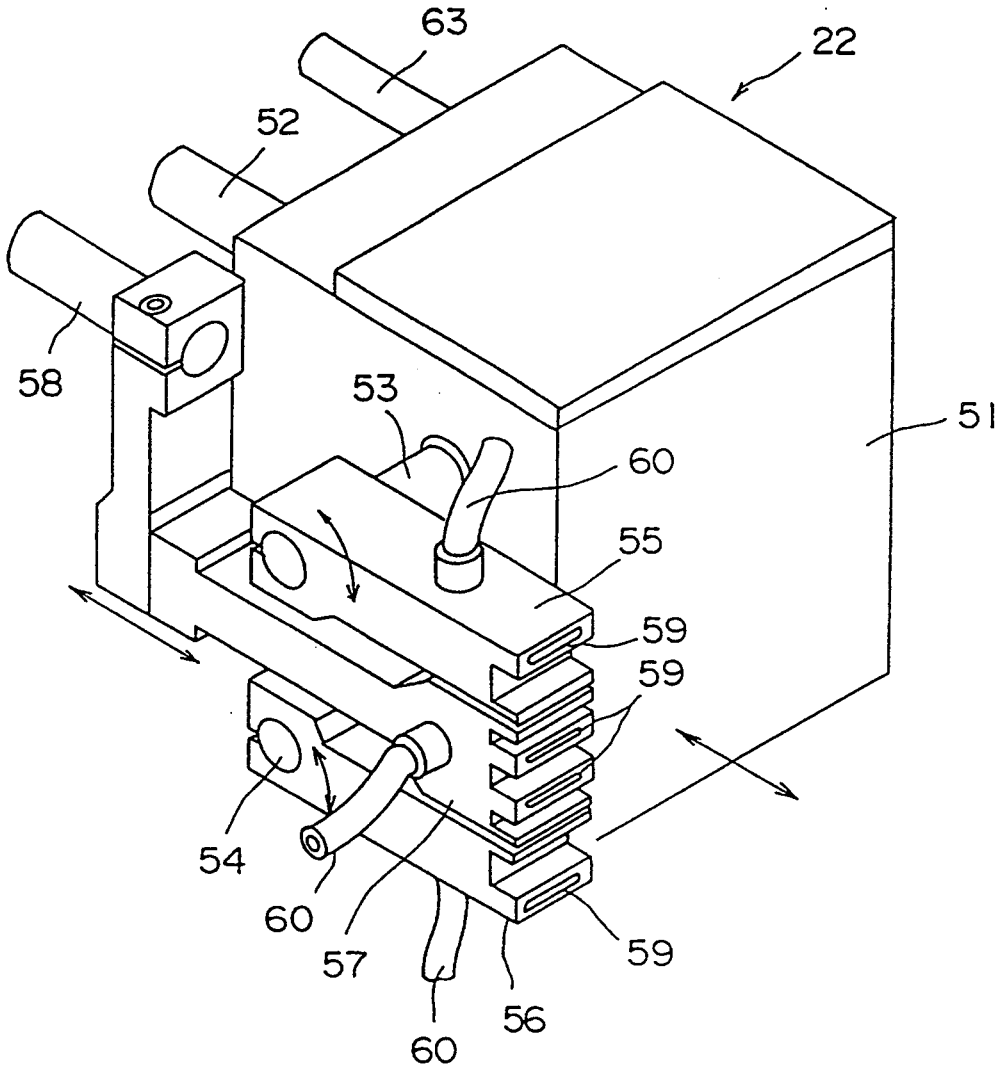
FIG. 5 is a general perspective view of a seal applying mechanism.

FIG. 5 shows the main part of the sealing mechanism 22 which has a casing 51 connected to a rod 52 and reciprocated radially thereby. Rotary shafts 53 and 54 extend outward from the casing 51. To the front ends of the rotary shafts 53 and 54 are fixed seal folding members 55 and 56 each having a front end directed radially outward of the rotary table 11. In other words, the front end of each of the members 55 and 56 causes the upper end face of the cigarette case P (transferred together with the head 13), to which a seal is to be applied, to be directed in the radially outward direction of the rotary table 11. The seal folding members 55 and 56 reciprocate in the radial directions of the rotary table 11 together with the casing 51 such that the rotary shafts 53 and 54 are rotated in the opposite directions, whereby the seal folding members 55 and 56 are opened and closed selectively as shown by two-headed arrows in FIG. 5.

Between the seal folding members 55 and 56, a seal pressing member 57 is provided and is fixed to a rod 58 which reciprocates independently of the seal folding members 55 and 56. The height of the front end face of the seal pressing member 57 is substantially equal to the thickness of the cigarette case P.

At the front end faces of the seal folding members 55 and 56, open slit-like suction ports 59 are provided which are connected to a conventional suction device (not shown) via of a flexible hose 60.

Each member of the sealing mechanism 22 is operated by means of a cam mechanism as shown in FIG. 6. The rod 52 connected to the casing 51 is slidably supported by the rotary table 11 and connected to a cam roller 61 which is fitted in the cam groove formed in a cam 62 secured to the fixed shaft 12.

The rotary shafts 53 and 54 are rotatably supported by the casing 51 and connected together by means of gears 67 and 68 in the casing 51 such that they are rotated in the opposite directions. The rotary shaft 53 is connected to a rod 63 by means of a lever 65 slidably supported by the rotary table 11 and a link 64 connected to a cam roller 69. The fixed shaft 12 is secured to a cam 70 having a cam groove in which the cam roller 69 is fitted.

The rod 58 connected to the seal pressing member 57 is also reciprocated by a cam mechanism which has the same structure as the one for the rod 52 as described above and has a cam roller 71 making rolling contact with a cam 72 as shown in FIG. 6 such that the seal pressing members 57, 55 and 56 are driven at predetermined timing in accordance with the rotation of the rotary table 11.

Figure 7:
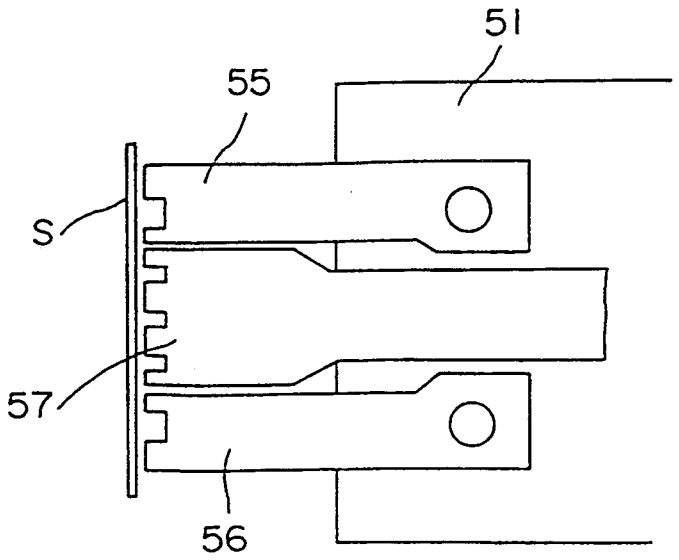
FIG. 7 is a general view of a state illustrating the operation of the apparatus according to this invention.

The operation of the apparatus will now be described with reference to FIGS. 7 to 10. First, as shown in FIG. 7, the seal folding members 55 and 56 of the head 13 are closed and their front end faces and the front end face of the seal pressing member 57 are disposed on the same plane. When the head 13 is moved to the position corresponding to the seal supplying mechanism 17, a seal S is supplied to the front face of the head 13 and is sucked and held thereby under a negative pressure produced at the suction ports 59. When the head 13 holding the seal S is moved to the position corresponding to the adhesive supplying mechanism 18, an adhesive is applied to the rear face of the seal S.

when the head 13 is moved to the position corresponding to the cigarette case P which is held by the cigarette-case supplying mechanism 15 and is disposed at the inlet of the guide 14 at the level of the passage 14, the holding members 40, 41 and 42 of the holding-moving mechanism 21 are rotated downward to hold the cigarette case P. Thereafter, the cigarette case p together with the head 13 is moved on and along the guide 14.

Figure 8:
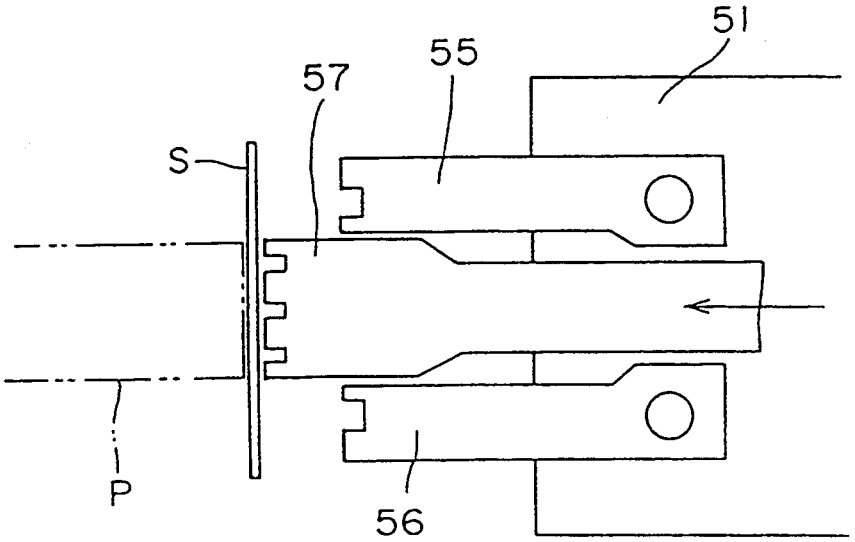
FIG. 8 is a general view of another state illustrating the operation of the apparatus according to this invention.
Figure 9:
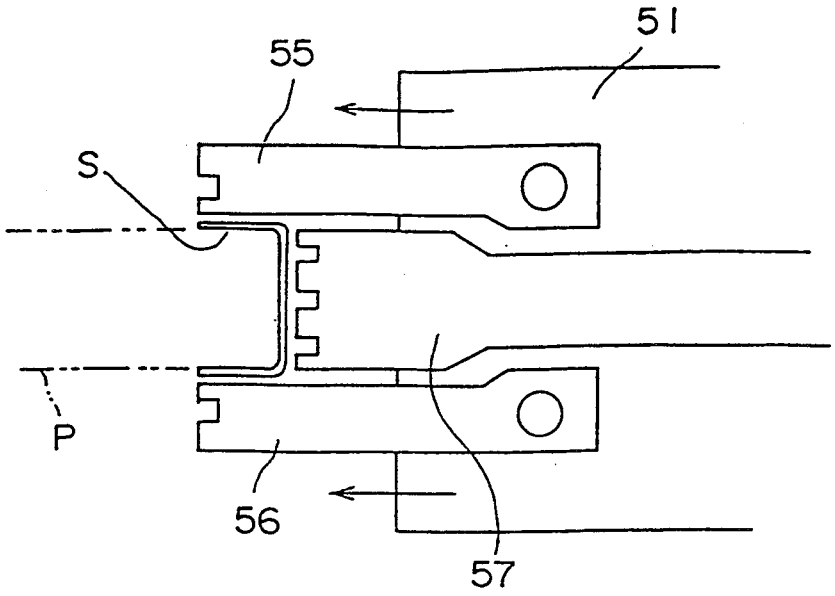
FIG. 9 is a general view of a further state illustrating the operation of the apparatus according to this invention.

As the cigarette case P starts to move together with the head 13, the seal pressing member 57 advances as shown in FIG. 8 and presses the central portion of the seal S against the central portion of the upper end face of the cigarette case P so as to hold the cigarette case P.

Figure 10:
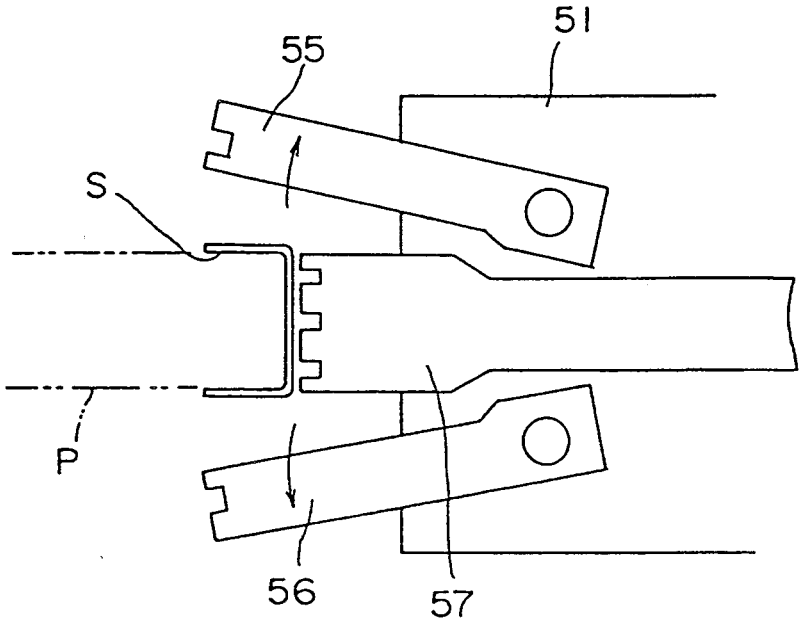
FIG. 10 is a general view of a still further state illustrating the operation of the apparatus according to this invention.

Thereafter, the seal folding members 55 and 56 together with the casing 51 are advanced beyond the position of the seal pressing member 57, and both end portions of the seal S are held between the seal folding members 55 and 56 and folded on both side faces of the cigarette case P. Then, the cigarette case P is moved to the outlet portion of the guide 14 in this state. During the transfer of the cigarette case P on the guide 14, the seal S is attached to the cigarette case P.

when the cigarette case P arrives at the outlet portion of the guide 14, the seal folding members 55 and 56 are opened as shown in FIG. 10 to release the cigarette case P. The cigarette case P applied with the seal S is sent to the next process by means of the transportation conveyer 16.

This invention is not limited to the above-mentioned embodiment. For example, the holding-moving mechanism and the sealing mechanism are not limited to above-mentioned cam mechanisms but various mechanisms can be applied thereto.

As described above, according to this invention, each article is held by the holding-moving mechanism of each head and transferred to a guide together with the head. While the article together with the head is moving on and along the guide, a seal is applied to the article by means of a sealing mechanism.

With the apparatus according to this invention, therefore, seals are applied to cigarette cases while the cigarette cases are being continuously transferred without being moved intermittently, whereby sealing operation can be performed at a high speed. Further, the seal-folding time can be prolonged, ensuring seal adhesion to cigarette cases.

The sealing apparatus according to this invention comprises mechanisms necessary for completing the sealing operation starting with applying the central portions of seals to the central portions of the upper end faces of cigarette cases and ending with attaching both end portions of the seals to both side faces of the cigarette cases. Accordingly, the number of cigarette cases to which seals have not yet been completely attached during the sealing operation is very few. If, therefore, it happens that the apparatus stops during the sealing operation, very few unfinished cigarette cases, that is, very few "no good" cigarette cases are produced.

This invention is not limited to a general apparatus for applying seals to cigarette cases but is applicable to the apparatus for applying small labels such as seals to the surfaces of articles such as cases of foods, pharmaceutical substances, cosmetics, etc.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus for applying small labels to articles, comprising:

a rotary table continuously rotatable in a horizontal plane and having peripheral portions;

an arcuate article guide provided around said rotary table; and heads provided on said peripheral portions of said rotary table, each of said heads having;

a holding-moving mechanism for holding an article loaded on said article guide and transferring said article on and along said article guide together with said each head in accordance with rotation of said rotary table, each holding-moving mechanism having three movable holding members for simultaneously holding three sides of the article, a fourth side of the article being exposed, the three holding members being pivotable to engage the three sides of the article, first, second and third holding members being pivotable about first, second and third rotary shafts, the first and second rotary shafts being generally parallel and the third rotary shaft being generally perpendicular to the first and second shafts, and a labeling mechanism for applying a label to said article when said article is being transferred on and along said article guide together with said each head and when the three holding members are holding the article, the label being applied to the fourth exposed side of the article.

2. The apparatus according to claim 1, wherein said three members are movable downward into abutment against a peripheral portion of said article disposed on said article guide, for transferring said article on and along said article guide.

3. The apparatus according to claim 1, wherein said labeling mechanism is provided on a front end face thereof with a label pressing member for sucking and holding said label under a negative pressure and for pressing said label against an end face of said article as said label pressing member advances, and label folding members provided on both sides of said label pressing member, for folding both end portions of said label on both sides of said article as said label pressing member further advances.

4. The apparatus according to claim 3, wherein two label folding members are provided, each label folding member having means for applying a negative pressure to the label in addition to the negative pressure applied by the label pressing member of the labeling mechanism, the two label folding members being independently movable relative to the label pressing member.

5. The apparatus according to claim 4, wherein both the label pressing member and the two label folding members are movable toward and away from the article held by the holding-moving mechanism.

6. The apparatus according to claim 4, wherein the two label folding members are pivotable relative to the label pressing member.

7. The apparatus according to claim 4, wherein the two label folding members are pivotable in opposite directions, the two label folding members being pivotable away from the article held by the holding-moving mechanism while the label pressing member remains engaged with the exposed fourth side of the article.

8. The apparatus according to claim 4, wherein the label pressing member and the two label folding members are slidable toward and away from the article held by the holding-moving mechanism and wherein the two label folding members are pivotable relative to the label pressing member, the two label folding members each having a pivot axis and the pivot axes of the two label folding members being generally linearly slidable away from the article while the label pressing member remains in engagement with the article.

9. The apparatus according to claim 4, wherein the two label folding members apply the label to a top and bottom of the article while the label pressing member applies the label to the exposed side of the article, the article having four sides with the top and bottom of the article being between the four sides.

10. An apparatus for applying small labels to articles, comprising:

a rotary table continuously rotatable in a horizontal plane and having peripheral portions, the rotatable table being rotatable about a rotation axis;

an arcuate article guide provided around said rotary table;

heads provided on said peripheral portions of said rotary table, each of said heads having;

a holding-moving mechanism for holding an article loaded on said article guide and transferring said article on and along said article guide together with said each head in accordance with rotation of said rotary table, each holding-moving mechanism having three movable holding members for simultaneously holding three sides of the article, a fourth side of the article being exposed, and a labeling mechanism for applying a label to said article when said article is being transferred on and along said article guide together with said each head and when the three holding members are holding the article, the label being applied to the fourth exposed side of the article; and a first cam, a second cam and a third cam, the first, second and third cams being generally centered about the rotation axis, each cam being engaged by at least one cam roller, the first cam being operatively connected to at least the holding-moving mechanism, the second cam being operatively connected to the holding-moving mechanism and the third cam being operatively connected to the labeling mechanism, the first cam being operatively connected to one of the three holding members by at least one cam roller and the second cam being operatively connected to two of the three holding members by at least one cam roller, the first and second cams being operatively connected to different holding members, rotation of the rotary table causing the cam rollers to follow the cams to move the labeling mechanism and the three holding members of the holding-moving mechanism.

11. The apparatus according to claim 10, wherein the first cam is also operatively connected to the labeling mechanism by a cam roller to move the label pressing member toward and away from the article during rotation of the rotary table.

12. The apparatus according to claim 11, wherein the third cam is engaged by two labeling mechanism cam rollers, a first one of the two labeling mechanism cam rollers moving the labeling mechanism toward and away from the article during rotation of the rotary table and a second one of the two labeling mechanism cam rollers pivoting portions of the labeling mechanism away from the article during rotation of the rotary table.

13. The apparatus according to claim 12, wherein the pivoting portions of the labeling mechanism comprise two label folding members and a label pressing member, the label folding members being on two sides of the label pressing member and being pivotable in opposite directions, the label folding members being advanced beyond the exposed side of the article while the label pressing member is engaged with the exposed side of the article to fold the label onto the article.

14. The apparatus according to claim 10, wherein the cam rollers on the first and second cams move the three holding members into engagement with the article before the cam roller on the third cam moves the labeling mechanism toward the article.

15. An apparatus for applying small labels to articles, comprising:

a rotary table continuously rotatable in a horizontal plane and having peripheral portions;

an arcuate article guide provided around said rotary table; and heads provided on said peripheral portions of said rotary table, each of said heads having;

a holding-moving mechanism for holding an article loaded on said article guide and transferring said article on and along said article guide together with said each head in accordance with rotation of said rotary table, each holding-moving mechanism having three movable holding members for simultaneously holding three sides of the article, a fourth side of the article being exposed, and a labeling mechanism for applying a label to said article when said article is being transferred on and along said article guide together with said each head and when the three holding members are holding the article, the label being applied to the fourth exposed side of the article, the labeling mechanism being provided with a label pressing member and with at least one label folding member, the label pressing member and the at least one label folding member being independently slidable toward and away from the article held by the holding-moving mechanism, the at least one label folding member being pivotable about a pivot axis relative to a front end face of the label folding member and the pivot axis being generally linearly slidable away from the article while the label pressing member remains in engagement with the article.

16. An apparatus for applying small labels to articles, comprising:

a rotary table continuously rotatable in a horizontal plane and having peripheral portions;

an arcuate article guide provided around said rotary table; and heads provided on said peripheral portions of said rotary table, each of said heads having, a holding-moving mechanism for holding an article loaded on said article guide and transferring said article on and along said article guide together with said each head in accordance with rotation of said rotary table, each holding-moving mechanism having three movable holding members for simultaneously holding three sides of the article, a fourth side of the article being exposed, and a labeling mechanism for applying a label to said article when said article is being transferred on and along said article guide together with said each head and when the three holding members are holding the article, the label being applied to the fourth exposed side of the article, the three holding members of the holding-moving mechanism first engage the article and then the labeling mechanism applies the label to the article, the labeling mechanism applies the label to the exposed side of the article as well as to a top and bottom of the article.

17. The apparatus according to claim 14, wherein the three holding members of the holding-moving mechanism are pivotable to engage the three sides of the article, first, second and third holding members being pivotable about first, second and third rotary shafts, the first and second rotary shafts being generally parallel and the third rotary shaft being generally perpendicular to the first and second shafts.

* * * * *